US007240823B1

(12) United States Patent
Saidiazar

(10) Patent No.: US 7,240,823 B1
(45) Date of Patent: Jul. 10, 2007

(54) GARAGE DOOR MAIL BAG ASSEMBLY

(76) Inventor: Jafar Saidiazar, 1115 Clayton St., San Francisco, CA (US) 94117

( * ) Notice: Subject to any disclaimer, the term of this patent is extended or adjusted under 35 U.S.C. 154(b) by 25 days.

(21) Appl. No.: 11/527,260

(22) Filed: Sep. 26, 2006

(51) Int. Cl.
*A47G 29/12* (2006.01)

(52) U.S. Cl. ..... 232/19

(58) Field of Classification Search ..... 232/30–32, 232/19, 45
See application file for complete search history.

(56) References Cited

U.S. PATENT DOCUMENTS 2,829,820 A * 4/1958 Evers ..... 232/19
4,826,075 A * 5/1989 Burns ..... 232/19
5,029,753 A * 7/1991 Hipon et al. ..... 232/22
5,492,272 A * 2/1996 Fewer ..... 232/19
5,897,053 A * 4/1999 Cirimele ..... 232/19
2002/0070269 A1* 6/2002 Rosiello et al. ..... 232/19

* cited by examiner

*Primary Examiner*—William L. Miller
(74) *Attorney, Agent, or Firm*—Girard & Eqiutz LLP

(57) ABSTRACT

In some embodiments, a mail bag assembly designed to be attached to a garage door in a position to collect mail passed through a mail slot in the garage door. The assembly includes a mail bag having an opening for receiving mail, and a supporting subassembly (which can include a rod) coupled to the bag so as to hold open the mail-receiving opening. The supporting subassembly is configured to be mounted to a garage door and to support the bag in an open, mail-holding position. The bag is shaped and dimensioned so as to receive and hold mail (when supported by the supporting subassembly below a mail slot in the garage door in the mail-holding position with the door in a closed, vertical position) and to prevent the mail from falling out of the bag when the door is opened. Various embodiments of the assembly can be easily installed on any type of garage door, including residential or industrial wood garage doors and composite or metal garage doors with trust support.

12 Claims, 15 Drawing Sheets

GARAGE DOOR MAIL BAG ASSEMBLY

FIELD OF THE INVENTION

The present invention pertains to an improved mail bag assembly that can be attached to a garage door to receive and hold mail passed through a mail slot in the door.

BACKGROUND OF THE INVENTION

It has been proposed to mount mail receptacles of various types to a garage door to receive mail passed through a mail slot in the door. However, there is a need for a garage door mail receptacle having simple, inexpensive design that can be installed on any type of garage door, including residential or industrial wood garage doors with half inch or more door wood thickness and composite or metal garage doors with trust support, and is capable of receiving and holding mail when in a vertical mail-holding position (when mounted below the mail slot with the door in a closed, vertical position) and prevents the mail from falling out of the receptacle when the door is opened (i.e., moved from the closed, vertical position to an open, horizontal position). There is also a need for such a garage door mail receptacle that can conveniently folded against a garage door when not in use (for convenience).

SUMMARY OF THE INVENTION

In a class of embodiments, the invention is a mail bag assembly designed and engineered to be attached to a garage door in a position to collect mail (e.g., envelopes and packages) passed through a mail slot in the garage door. Various embodiments of the assembly can be installed on any type of garage door, including residential or industrial wood garage doors (installation on doors having at least half inch wood thickness is especially easy) and composite or metal garage doors with trust support.

The assembly includes a mail bag having an opening for receiving mail, and a supporting subassembly (typically including a rod) coupled to the bag so as to hold open the mail-receiving opening. The supporting subassembly is configured to be mounted to a garage door and to support the bag in an open, mail-holding position. The bag is shaped and dimensioned so as to receive and hold mail (when supported by the supporting subassembly below a mail slot in the garage door in the mail-holding position with the door in a closed, vertical position) and to prevent the mail from falling out of the bag when the door is opened (i.e., moved from the closed, vertical position to an open, horizontal position).

In preferred embodiments, the supporting subassembly rotatably mounts the mail bag to the door so that the bag can be folded against the door when not in use (for convenience) as the supporting subassembly rotates relative to the door. Preferably, the inventive assembly includes a fastener (e.g., a hook and loop fastener) for releasably holding the bag in a folded position against the door. Preferably, the assembly is sufficiently lightweight and the fastener holds the bag against the door with sufficiently weak force that force exerted by mail (e.g., packages) against the bag (when the mail is pushed through the mail slot against the bag assembly in its folded position) disengages the fastener and rotates the bag back into the mail-holding position in which it holds the mail.

Brackets having rod-receiving grooves can be used to mount typical embodiments of the supporting subassembly rotatably to a garage door (e.g., one that does not have outward-protruding trusts). Generally U-shaped brackets can be used to mount typical embodiments of the supporting subassembly to a trust member of a garage door having outward-protruding trusts.

Another aspect of the invention is a garage door to which any embodiment of the inventive mail bag assembly is mounted.

DETAILED DESCRIPTION OF THE INVENTION

A first embodiment of the inventive mail bag assembly will be described with reference to FIGS. 1–5.

Figure 1:
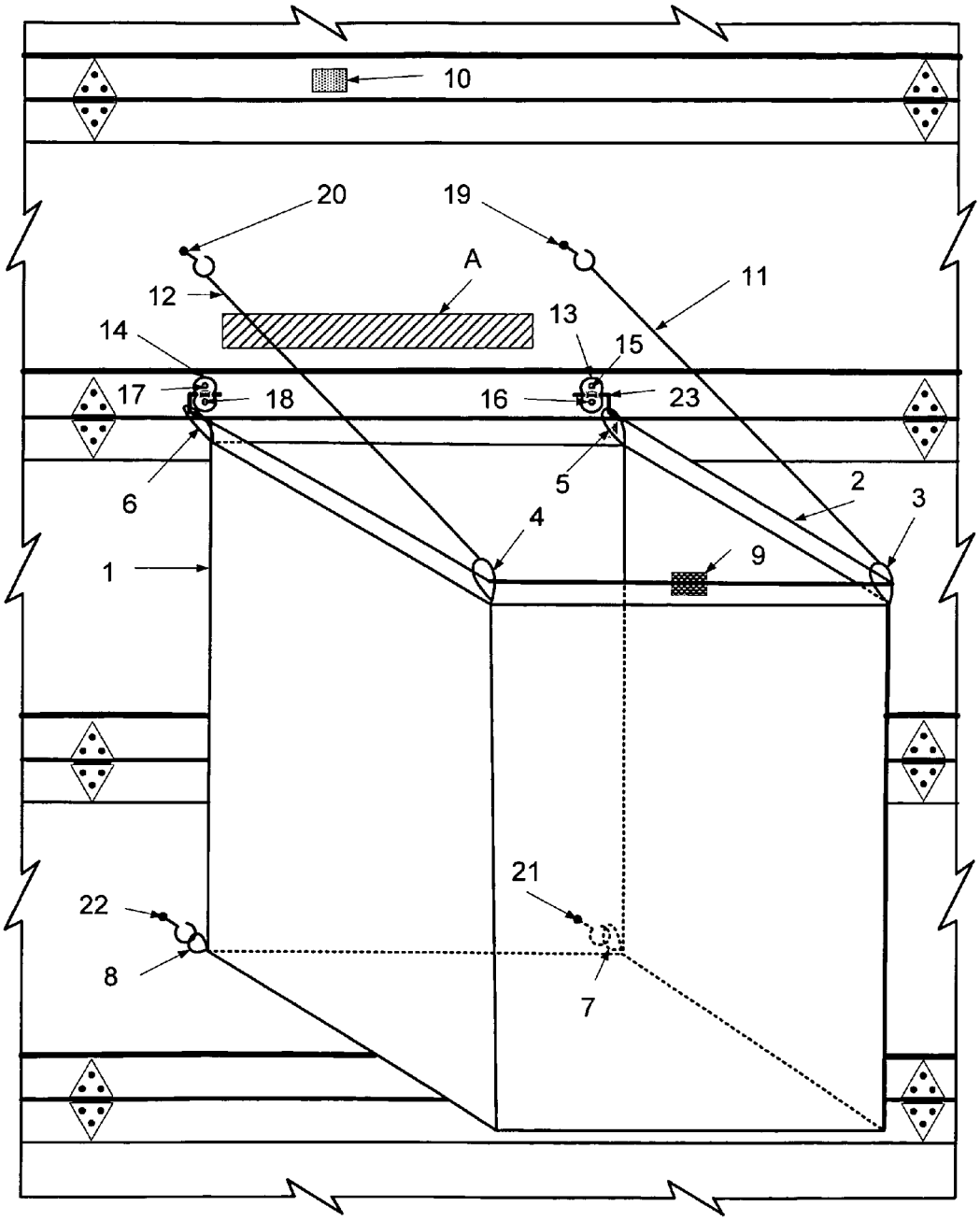
FIG. 1 is a perspective view of an embodiment of the inventive mail bag assembly installed on a wood garage door (which preferably has a wood thickness of at least 0.5 inch).
Figure 15:
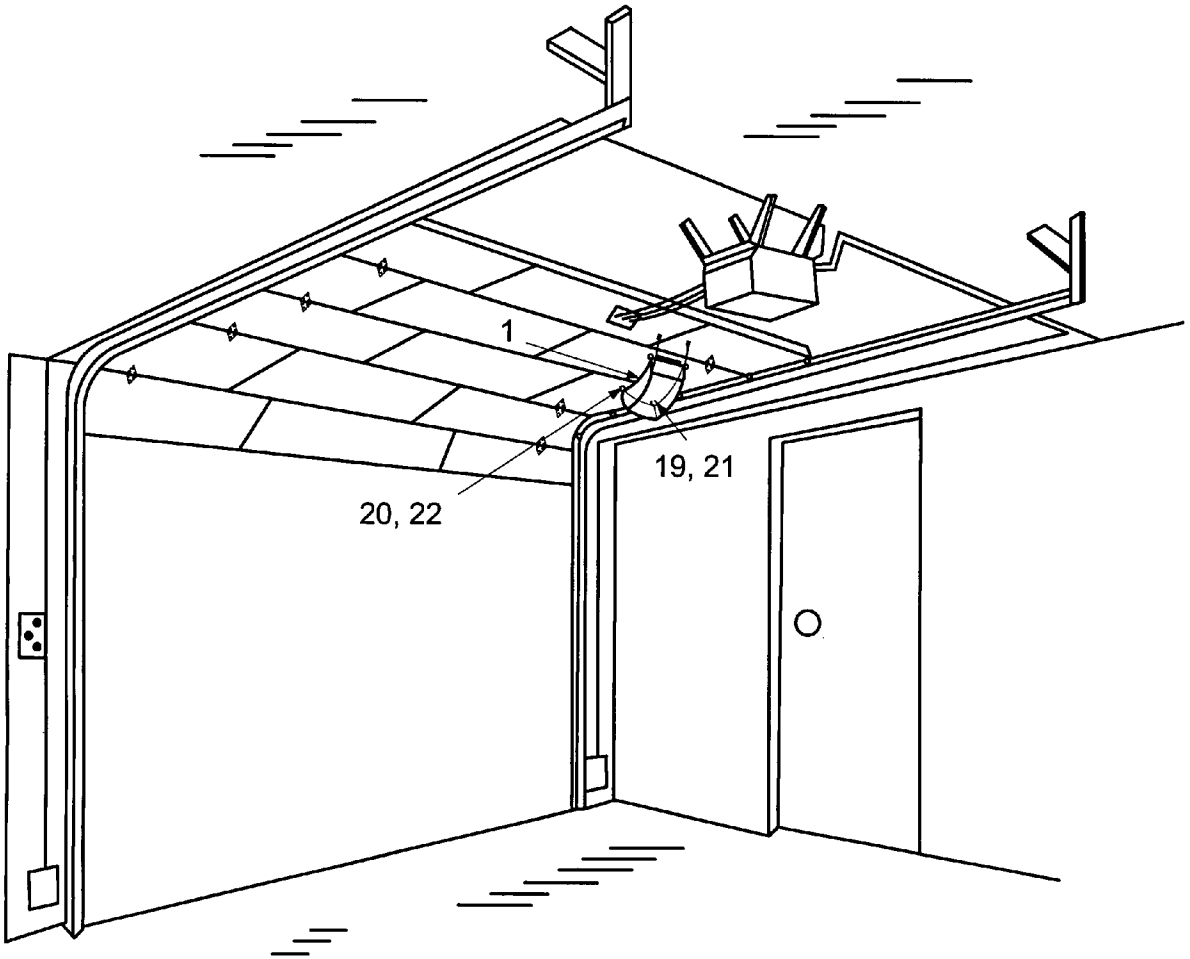
FIG. 15 is a perspective view of the assembly of FIG. 1, FIG. 6, or FIG. 12 mounted to a garage door in an open (horizontal) position.

Mail bag 1 of FIG. 1 can be installed onto a wood garage door (preferably having thickness of at least 0.5 inch) and supported in a mail-receiving position by rod 23, two metal brackets 13 and 14 attached by screws 15, 16, 17, and 18 to the door, and wood screw eyebolts (having hook portions) 19, 20, 21, and 22 which are screwed into the door. Optionally, screw eyebolts 19 and 20 are omitted, but if included, eyebolts 19 and 20 (and ropes 11 and 12 extending between eyebolts 19 and 20 and elastic loops 3 and 4 of bag 1)

provide additional support to increase the total mail weight capacity of the assembly (typically to about 12 lbs.). Screw eyebolts 21 and 22 are used to hold the back face of bag 1 in a horizontal position when the garage door is opened (as shown in FIG. 15).

Metal brackets 13 and 14 are preferably mounted one to six inches below the mail slot (A), one on each side of the mail slot (A), as shown in FIG. 1. Brackets 13 and 14 preferably have the shape shown in FIG. 5, which defines a rod-receiving groove for receiving one of the two bent ends of rod 23 (best shown in FIG. 4).

Eyebolts 19 and 20 are mounted to the door above the mail slot as shown. Hook portions of eyebolts 19 and 20 are connected to elastic loop portions 3 and 4 (made of elastic rope) of mail bag 1 by ropes 11 and 12 (preferably made of cotton). Optionally, elements 19, 20, 11, and 12 are omitted. If used, they provide additional support to bag 1 to increase its total mail capacity (typically up to about 12 lbs.).

Eyebolts 21 and 22 are mounted to the door below the mail slot as shown. Hook portions of eyebolts 21 and 22 are connected to elastic loop portions 7 and 8 of mail bag 1 to support bag 1 during garage door opening and when the door is in the horizontal position. Eyebolts 19, 20, 21, and 22 have wood screw threads for easy mounting to the garage door.

Figure 3:
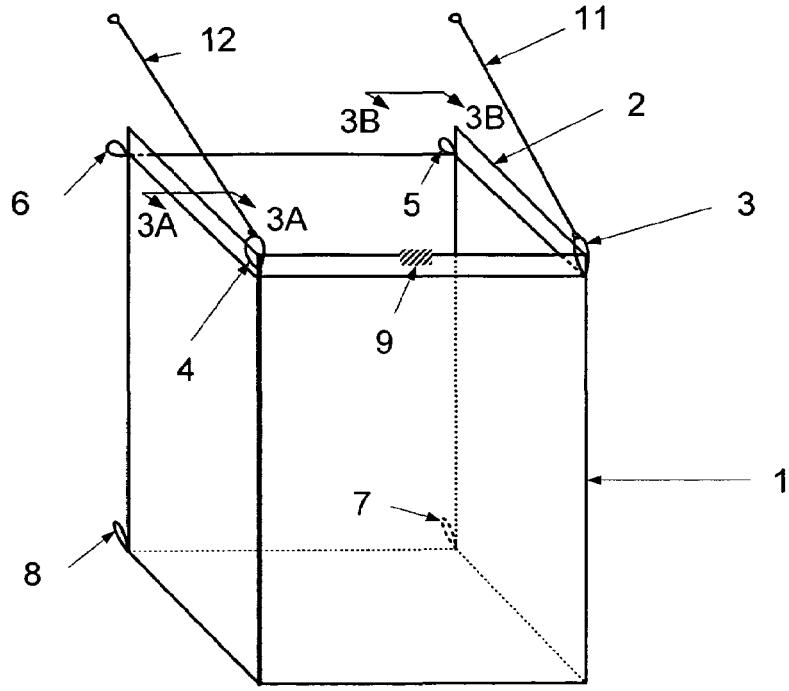
FIG. 3 is a perspective view of elements of the assembly of FIG. 1.
Figure 3A:
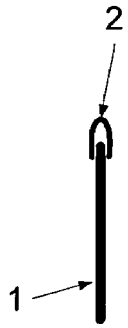
FIG. 3A is a detail of FIG. 3.
Figure 3B:
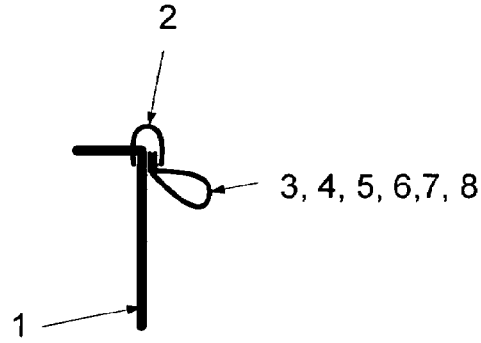
FIG. 3B is a detail of FIG. 3.

Metal rod 23 (best shown in FIG. 4) is inserted through trim portion 2 of bag 1 (portion 2 is affixed around three of the four top edges of bag 1 as shown in FIGS. 3, 3A, and 3B) to allow rod 23 to support bag 1 with the bent end portions of rod 23 protruding out from portion 2 so that they can be mounted to brackets 13 and 14. The bent ends of rod 23 are passed through elastic loop portions 5 and 6 (made of elastic rope) at upper corners of bag 1, and are inserted in the rod-receiving grooves of brackets 13 and 14 as shown in FIG. 1. When so assembled, rod 23 holds bag 1 open and in a vertical position (when the door is oriented vertically), and elastic ropes 5 and 6 prevent bag 1 from sliding along rod 23 during garage opening. Each of brackets 13 and 14 is secured to the garage door with screws (15, 16, 17, and 18).

Hook portion 10 of a hook and loop (e.g., Velcro) fastener (comprising portions 9 and 10) is attached to the garage door. Loop portion 9 of this fastener is attached to rod-supporting trim portion 2 of the bag assembly in the position shown. Rod 23 and bag 1 are rotatably mounted to the garage door so that they can be folded up by 90 degrees by causing end portions of rod 23 to rotate in the rod-receiving grooves of brackets 13 and 14 and can be held in the folded position (by fastening element 9 against element 10) when not in use for convenience. Due to the light-weight of bag 1 and rod 23, the mail bag assembly rotates back to its original position when mail or packages are dropped into bag 1 through the mail slot (A).

Figure 2:
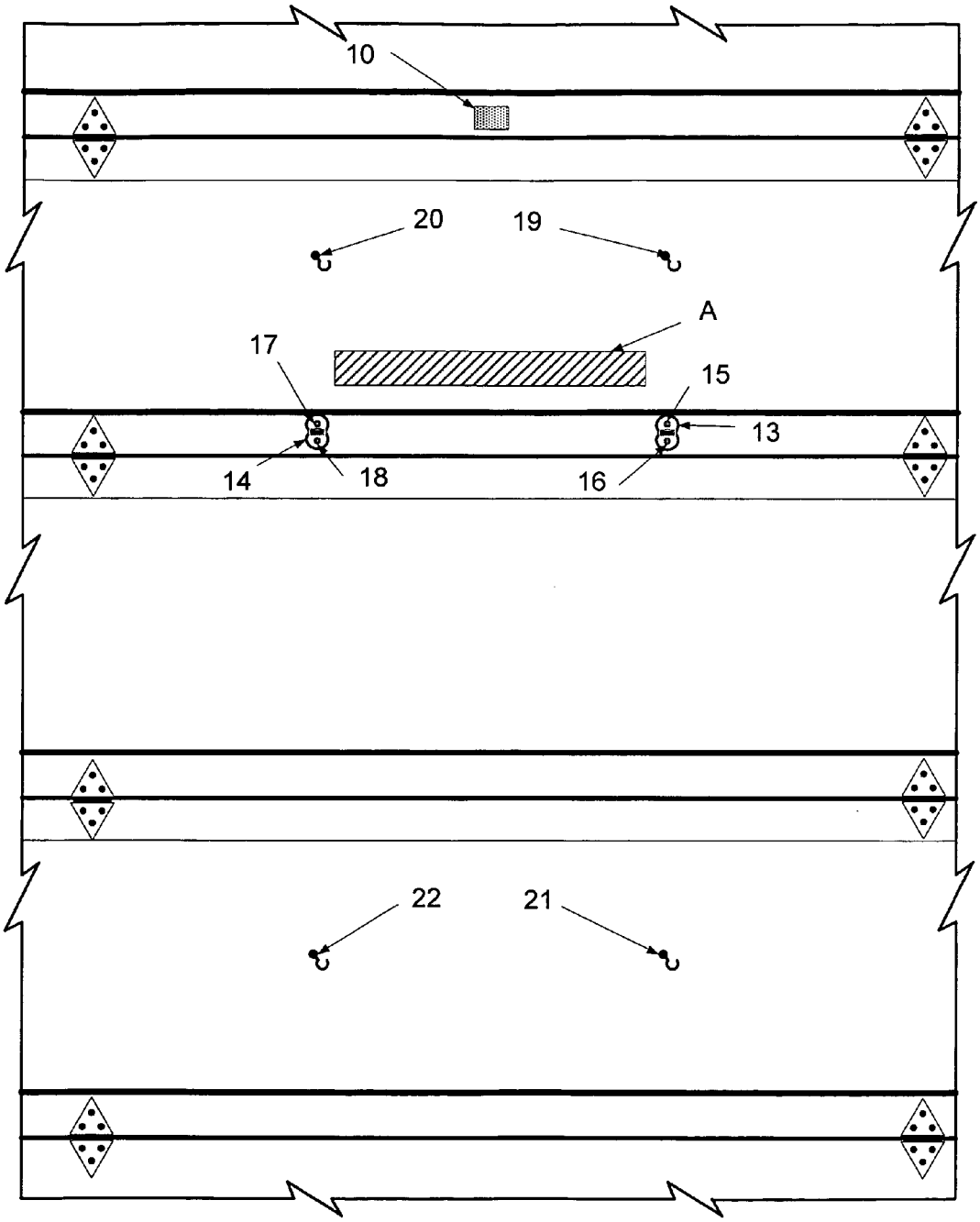
FIG. 2 is a diagram of elements of the FIG. 1 assembly.

FIG. 2 shows approximate locations of the elements of the mail bag assembly that are attached to the garage door. Metal brackets 13 and 14 are preferably attached to the garage door with #6 wood metal screws (15, 16, 17, and 18). These brackets can be mounted 1 to 6 inches below the mail slot (A) on each side of the mail slot (preferably 14 inches apart) as shown in FIG. 2.

Eyebolts 19 and 20 are mounted to the door above (preferably 2 to 8 inches above) brackets 13 and 14 (preferably fourteen inches apart from each other) as shown in FIG. 2. Eyebolts 21 and 22 are attached to the garage door below (preferably 16 inches below) brackets 13 and 14. Eyebolts 21 and 22 are mounted above (preferably two inches above) the bottom of bag 1 (which is preferably 18 inches long) to allow the load (e.g., envelopes and packages) to drop to the bottom of bag 1 when the garage door is in the open (horizontal) position.

Bag 1 has a mail-receiving opening (around three sides of which trim portion 2 is attached) and should be shaped and dimensioned so as to receive and hold mail when in its vertical, mail-holding position (i.e., when mounted below a garage door mail slot with the door in a closed, vertical position) and to prevent the mail from falling out of the bag when door is opened (i.e., moved from the closed, vertical position to an open, horizontal position).

FIG. 3 shows details of bag 1's design. Bag 1 is preferably made of a strong, light weight nylon fabric, and preferably has the following dimensions: 13" deep, 14" wide, and 18" long. Rod-supporting trim portion 2 of bag 1 preferably has a width of 1.5 inch and a length of 40 inches. Preferably, portion 2 is a separate piece of fabric trim that is attached (e.g., by top and bottom seams) to three of the four top edges (the left, right, and front edges) of the main portion of bag 1 as shown, so as to define an opening (preferably of about half inch diameter) between portion 2 and the main portion of bag 1 for receiving rod 23 as shown in FIGS. 3A and 3B.

Elastic ropes 3, 4, 5, 6, 7, and 8 are attached (as shown in FIGS. 3 and 3B) to six corners of bag 1 (the four back corners and two top front corners as shown) to form six elastic loops. When elastic ropes 5 and 6 on the upper back section of bag 1 extend around rod 23, they prevent bag 1 from sliding along rod 23 during garage opening.

Elastic ropes 3 and 4 are connected to the top front corners of bag 1. Optionally, rope 11 (which is preferably made of cotton) is attached between rope 3 and hook 19, and rope 12 (which is preferably also made of cotton) is attached between rope 4 and hook 20 as shown, to add additional support to bag 1 to increase the maximum amount of mail that can be carried within by bag 1. Elastic ropes 7 and 8 are connected to the lower back corners of bag 1 and connected to hooks 21 and 22, respectively, to add additional weight support and to hold bag 1 in the horizontal position when the garage door is in open (horizontal) position as shown in FIG. 15.

Figure 4:
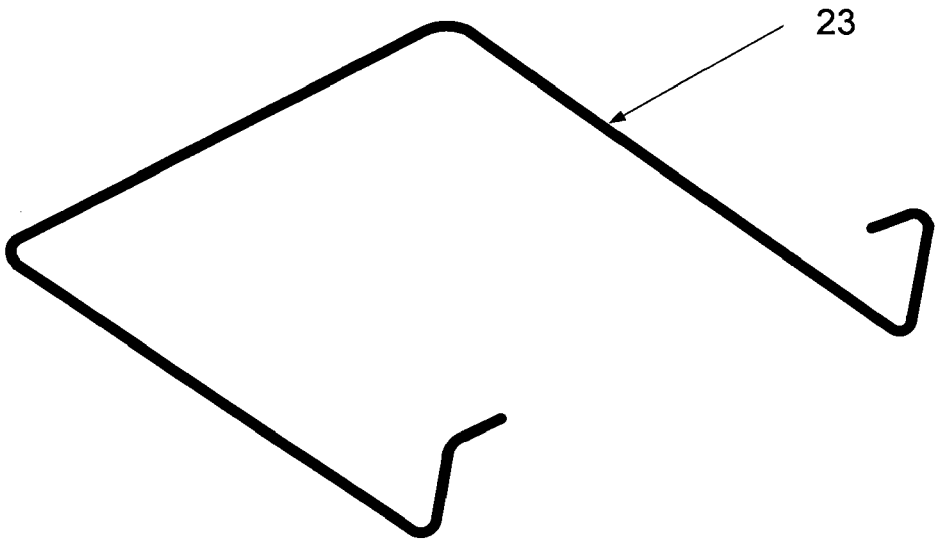
FIG. 4 is a perspective view of a rod of the FIG. 1 assembly.

Rod 23 is bent into the shape shown in FIG. 4. Preferably, rod 23 is made of Aluminum material and has 3/16 inch diameter. Rod 23 is shaped and dimensioned to be inserted in the opening between portion 2 and the main portion of bag 1 as shown in FIG. 1 to support the mail bag. Rod 23 is rotatably attached to the door by brackets 13 and 14 as shown in FIG. 1.

Figure 5:
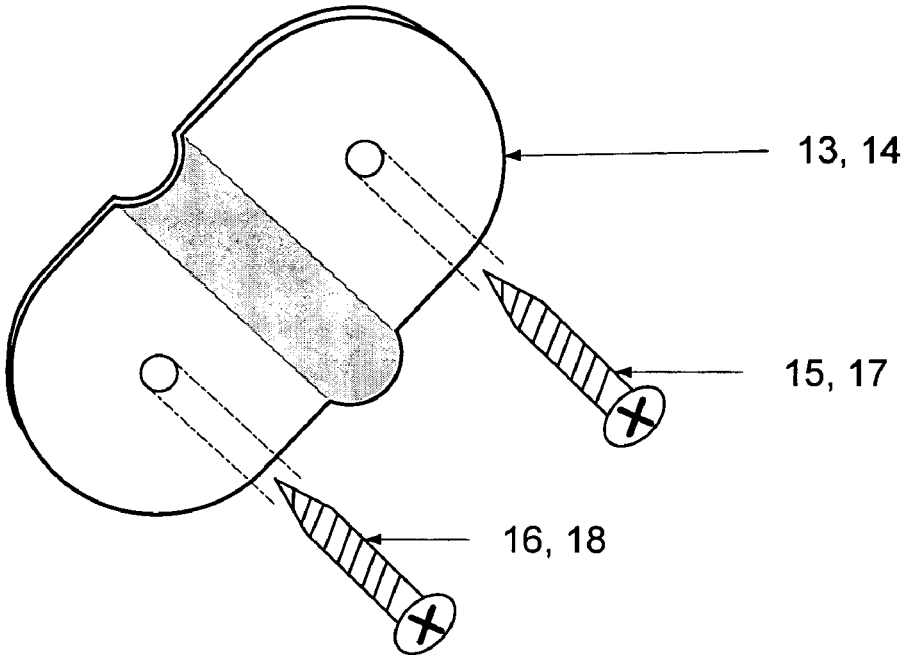
FIG. 5 is a perspective view of an embodiment of bracket 13 or 14 of FIG. 1.

Preferably, each of brackets 13 and 14 is shaped as shown in FIG. 5, is made of aluminum, and is secured to the garage door with two screws (e.g., #6 metal screws). Such brackets can be used for all wood, composite or metal garage doors, but brackets 111 and 112 (to be described with reference to FIGS. 10 and 11) are preferred for use with garage doors having protruding trust portions.

With reference to FIGS. 6–11, we next describe a second embodiment of the inventive mail bag assembly.

Figure 6:
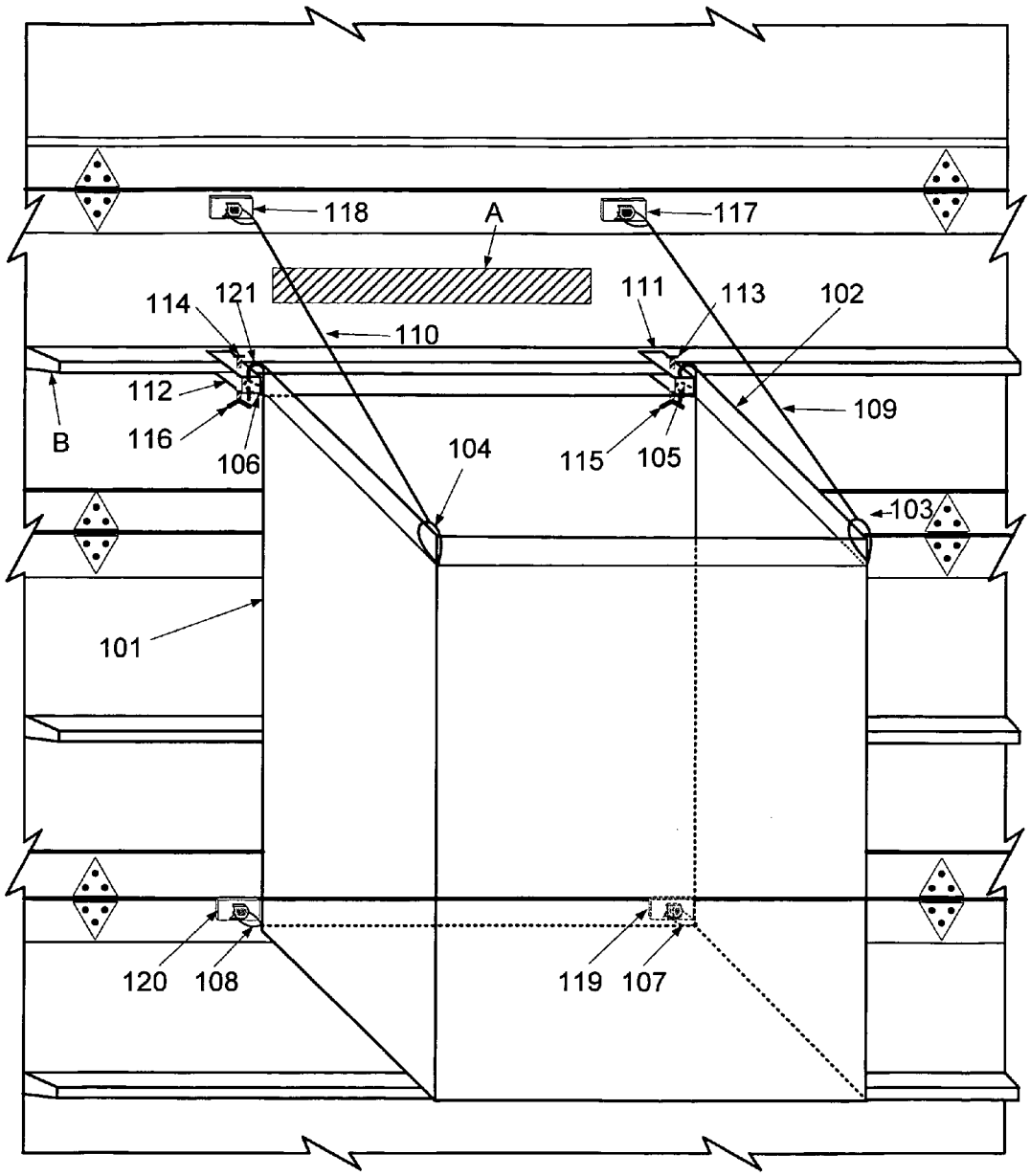
FIG. 6 is a perspective view of another embodiment of the inventive mail bag assembly installed on a garage door (e.g., a composite or metal garage door) having trusts (e.g., trusts each having a length of at least 1 inch) protruding outward therefrom.
Figure 10:
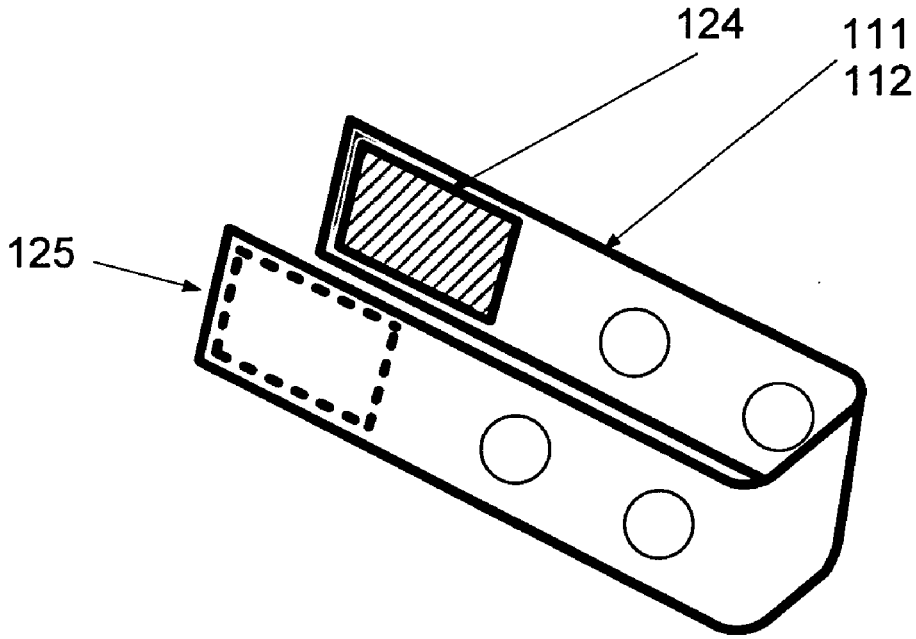
FIG. 10 is a perspective view of a bracket of the FIG. 6 assembly.

Mail bag 101 of FIG. 6 can be installed onto a garage door residential or industrial metal or composite garage door having trust portions (e.g., trust B) that extend out by at least 1 inch from the main surface of the door (i.e., a door having trust clearance of at least 1 inch) and supported in a mail-receiving position, by rod 121, two metal brackets 111 and 112 (preferably having shape as shown in FIG. 10) attached by screws and wing nuts (e.g., screw 113 or 114 and wing nut 115 or 116 of FIG. 11) to a trust of the door, and hooks 117, 118, 119, and 120 (attached to the door). Hooks 117 and 118 are optionally omitted, but if used, hooks 117 and 118 (and ropes 109 and 110 extending between hooks 117 and 118 and loops 103 and 104 of bag 101) provide additional support to increase the total mail weight capacity of the assembly (e.g., to 12 lbs.). Hooks 119 and 120 are used to hold the back face of bag 101 in a horizontal position when the garage door is opened (as shown in FIG. 15).

Brackets 111 and 112 are mounted on trust B to hold rod 121 in a generally horizontal position. Each of brackets 111 and 112 has two pairs of holes. A screw 113 (or 114) is inserted through one pair of holes and held in place by a wing nut 115 (or 116) to mount of each bracket to the trust. The ends of rod 121 are inserted through the other pair of holes to mount rod 121 to the bracket as shown in FIG. 6.

Optionally, hooks 117 and 118 are attached to the door above the mail slot (slot A). Hooks 117 and 118 can be connected to elastic loops 103 and 104 (made of elastic rope) of mail bag 101 with ropes 109 and 110 (which are preferably cotton ropes) to provide additional support to increase the total mail weight capacity of the assembly (e.g., to 12 lbs.).

Hooks 119 and 120 are attached to the garage door below the mail slot. Hooks 119 and 120 are connected to elastic loops 107 and 108 (made of elastic rope) of bag 101 for bag support during garage door opening and when the door is in the open (horizontal) position.

Figure 8:
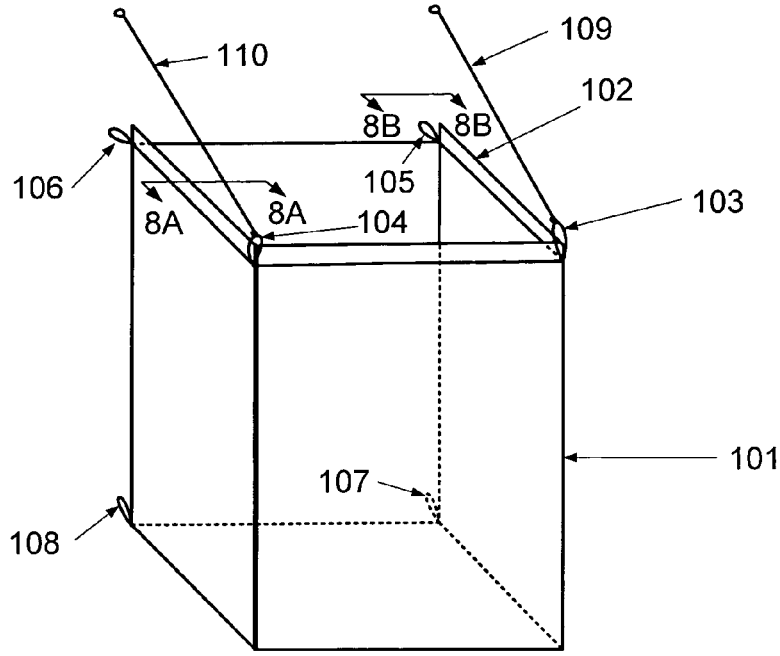
FIG. 8 is a perspective view of elements of the assembly of FIG. 6.
Figure 8A:
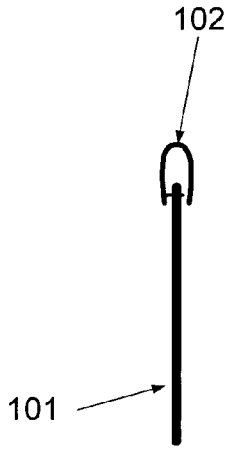
FIG. 8A is a detail of FIG. 8.
Figure 8B:
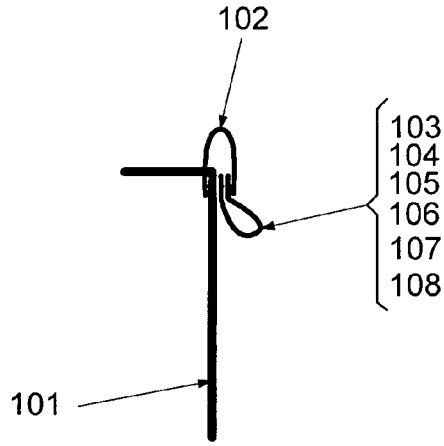
FIG. 8B is a detail of FIG. 8.

Metal rod 121 (best shown in FIG. 9) is inserted through trim portion 102 of bag 101 (portion 102 is affixed around three of the four top edges of bag 101 as shown in FIGS. 8, 8A, and 8B) to allow rod 121 to support bag 101 with the end portions of rod 121 protruding out from portion 102 so that they can be mounted to brackets 111 and 112. The ends of rod 121 are passed through elastic loop portions 105 and 106 (made of elastic rope) at upper corners of bag 101, and are inserted into rod-receiving holes of brackets 111 and 112 as shown in FIG. 6. When so assembled, rod 121 holds bag 101 open and in a vertical position (when the door is oriented vertically), and elastic ropes 105 and 106 prevent bag 101 from sliding along rod 121 during garage opening.

Figure 7:
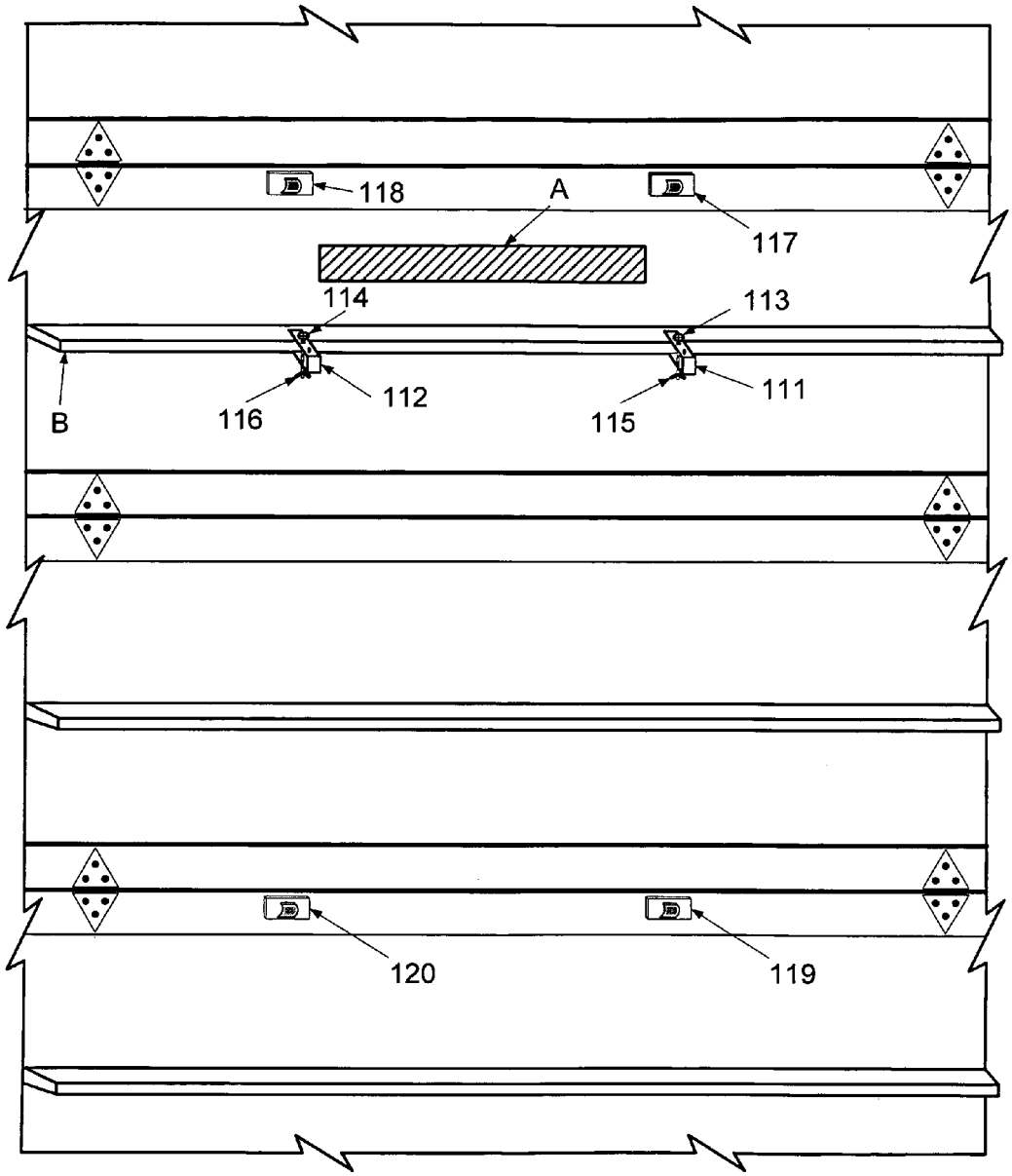
FIG. 7 is a diagram of elements of the FIG. 6 assembly.

FIG. 7 shows approximate locations of the elements of the mail bag assembly that are attached to the garage door. Metal brackets 111 and 112 are preferably attached as described to a trust (trust B) below the mail slot (A) on each side of the mail slot (preferably 14 inches apart) as shown in FIG. 7.

Hooks 117 and 118 are mounted to the door above (preferably 2 to 8 inches above) brackets 111 and 112 (preferably fourteen inches apart from each other) as shown in FIG. 7. Hooks 119 and 120 are mounted to the garage door below (preferably 16 inches below) brackets 111 and 112. Hooks 119 and 120 are mounted above (preferably two inches above) the bottom of bag 101 (which is preferably 18 inches long) to allow the load (e.g., envelopes and packages) to drop to the bottom of bag 101 when the garage door is in the open (horizontal) position. Hooks 117, 118, 119, and 120 are preferably plastic with strong adhesive backing for easy mounting.

Bag 101 should be shaped and dimensioned so as to receive and hold mail when in its vertical, mail-holding position (i.e., when mounted below a garage door mail slot with the door in a closed, vertical position) and to prevent the mail from falling out of the bag when door is opened (i.e., moved from the closed, vertical position to an open, horizontal position).

FIG. 8 shows details of bag 101's design. Bag 101 is preferably made of a strong, light weight nylon fabric, and preferably has the following dimensions: 13" deep, 14" wide, and 18" long. Rod-supporting trim portion 102 of bag 101 preferably has a width of 1.5 inch and a length of 40 inches. Preferably, portion 102 is a separate piece of fabric trim that is attached (e.g., by top and bottom seams) to three of the four top edges (the left, right, and front edges) of the main portion of bag 101 as shown, so as to define an opening (preferably of about half inch diameter) between portion 102 and the main portion of bag 101 for receiving rod 121 as shown in FIGS. 8A and 8B.

Elastic ropes 103, 104, 105, 106, 107, and 108 are attached (as shown in FIGS. 8 and 8B) to six corners of bag 101 (the four back corners and two top front corners as shown) to form six elastic loops. When elastic ropes 105 and 106 on the upper back section of bag 101 extend around rod 121, they prevent bag 101 from sliding along rod 121 during garage opening.

Elastic ropes 103 and 104 are connected to the top front corners of bag 101. Optionally, rope 109 (which is preferably made of cotton) is attached between rope 103 and hook 117, and rope 110 (which is preferably also made of cotton) is attached between rope 104 and hook 118 as shown, to add additional support to bag 101 to increase the maximum amount of mail that can be carried within by bag 101. Elastic ropes 107 and 108 are connected to the lower back corners of bag 101 and connected to hooks 119 and 120, respectively, to add additional weight support and to hold bag 101 in the horizontal position when the garage door is in open (horizontal) position as shown in FIG. 15.

Figure 9:
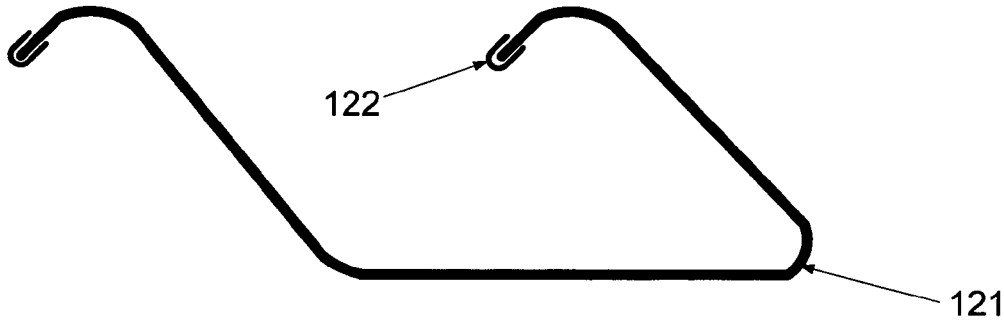
FIG. 9 is a perspective view of a rod of the FIG. 6 assembly.

Rod 121 is bent into the shape shown in FIG. 9. Preferably, rod 121 is made of Aluminum material and has 3/16 inch diameter. Rod 121 is shaped and dimensioned to be inserted in the opening between portion 102 and the main portion of bag 101 as shown in FIG. 6 to support the mail bag.

Figure 11:
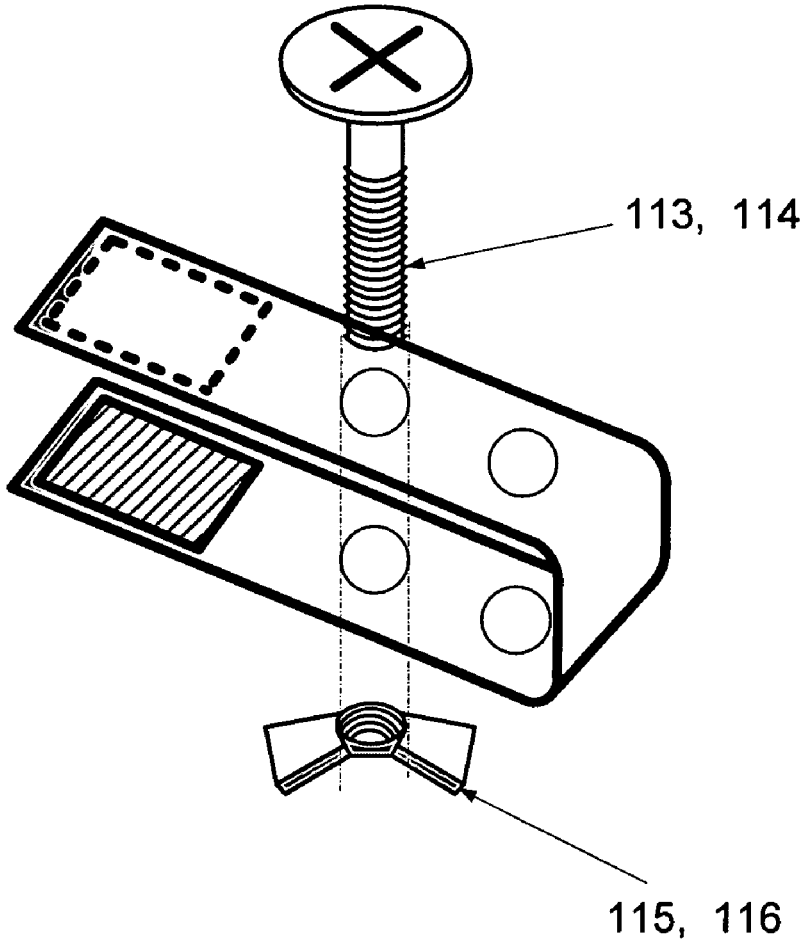
FIG. 11 is a perspective view of the bracket of FIG. 10 with a screw and wing nut for use in mounting it to a trust member of a garage door.

Preferably, each of brackets 111 and 112 is shaped as shown in FIGS. 10 and 11, is made of aluminum, and is secured to a trust of the garage door with screw 113 (or 114) and wing nut 115 (or 116). Also, squares of Velcro material (124, 125), preferably having size 1 inch×1 inch, are attached to each of brackets 111 and 112 as shown in FIG. 10.

Figure 12:
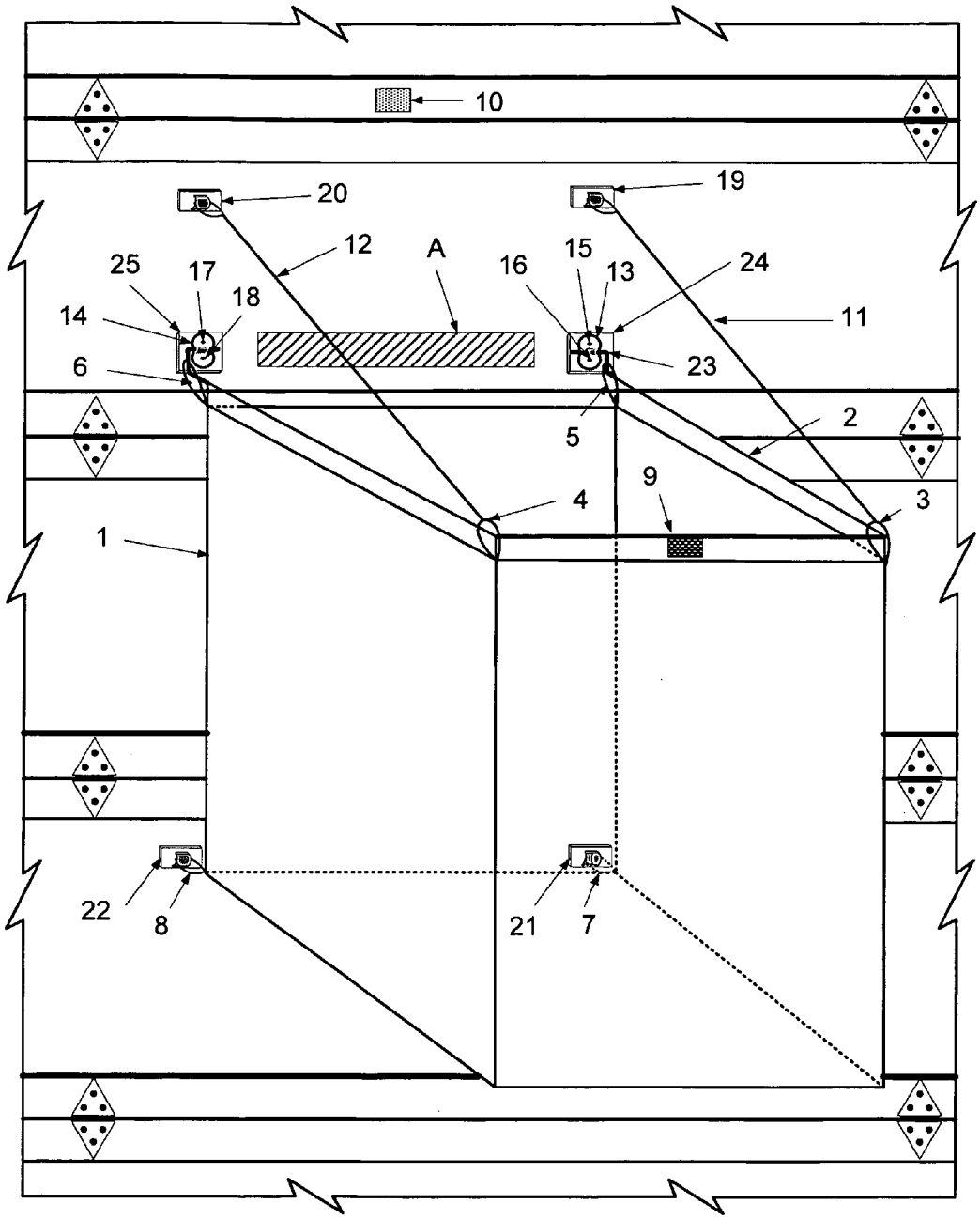
FIG. 12 is a perspective view of another embodiment of the inventive mail bag assembly installed on a garage door (e.g., a wood, composite, or metal garage door) having no trust protruding outward therefrom and having arbitrary thickness.
Figure 13:
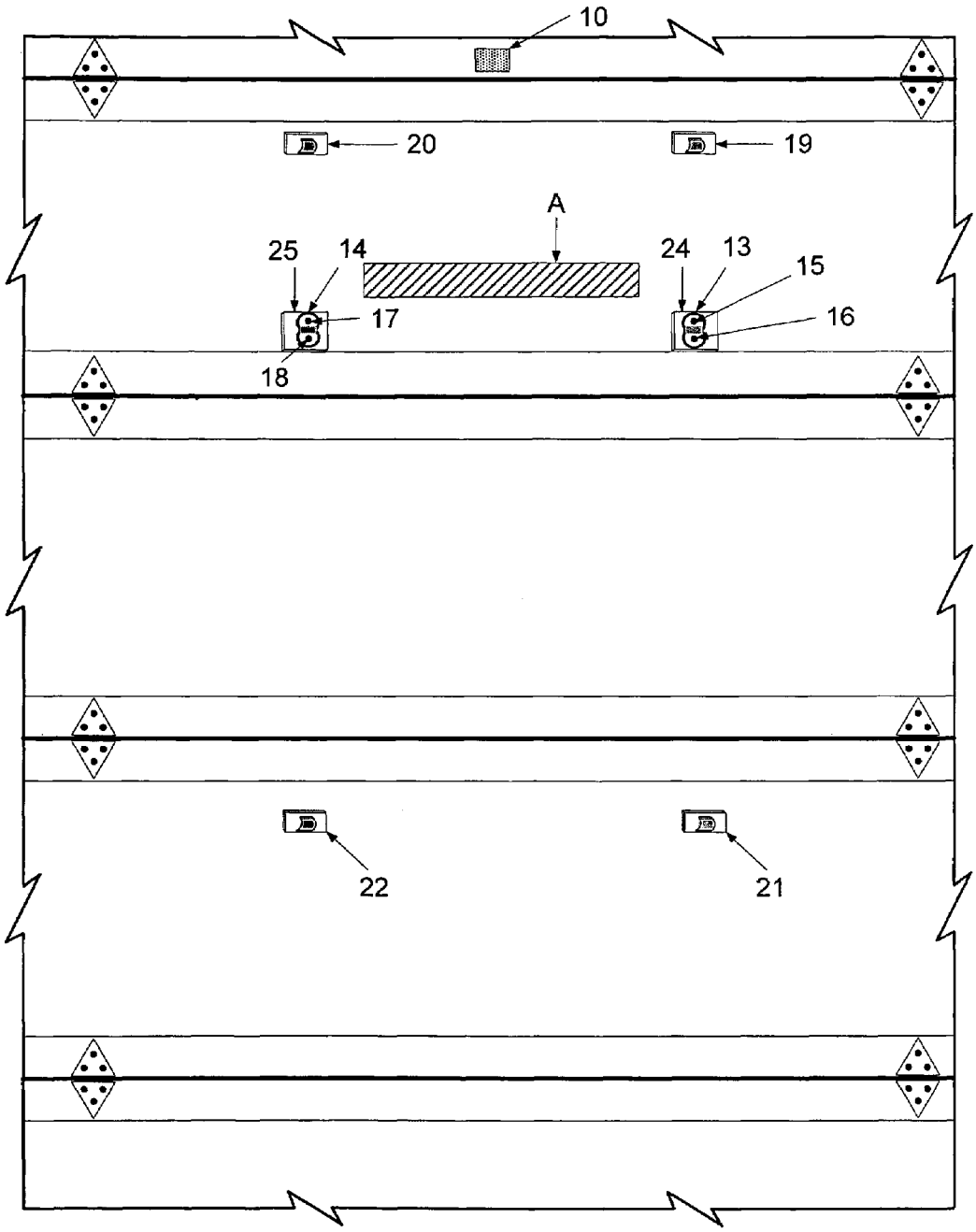
FIG. 13 is a diagram of elements of the FIG. 12 assembly.

If the garage door is made of wood having thickness less than 0.5 inches and/or is made of metal or composite material (and does not have 1" trust clearance), the mail bag assembly described with reference to FIGS. 1–5 can be installed by permanently gluing two additional wood brackets 24 and 25 (preferably having size 2"×2") to the garage door as shown in FIGS. 12 and 13, and then mounting brackets 13 and 14 to brackets 24 and 25 respectively and mounting the rest of the assembly to the door as described above. All elements of FIGS. 12 and 13 that are identical to elements of FIGS. 1–5 are numbered identically in both sets of figures.

Like bag 1 of the assembly of FIGS. 1–5, bag 1 of the assembly of FIGS. 12 and 13 can be folded up by 90 degrees against the garage door and attached to the garage door with a hook and loop (e.g. Velcro) fastener 9, 10 when not in use for convenience.

Figure 14:
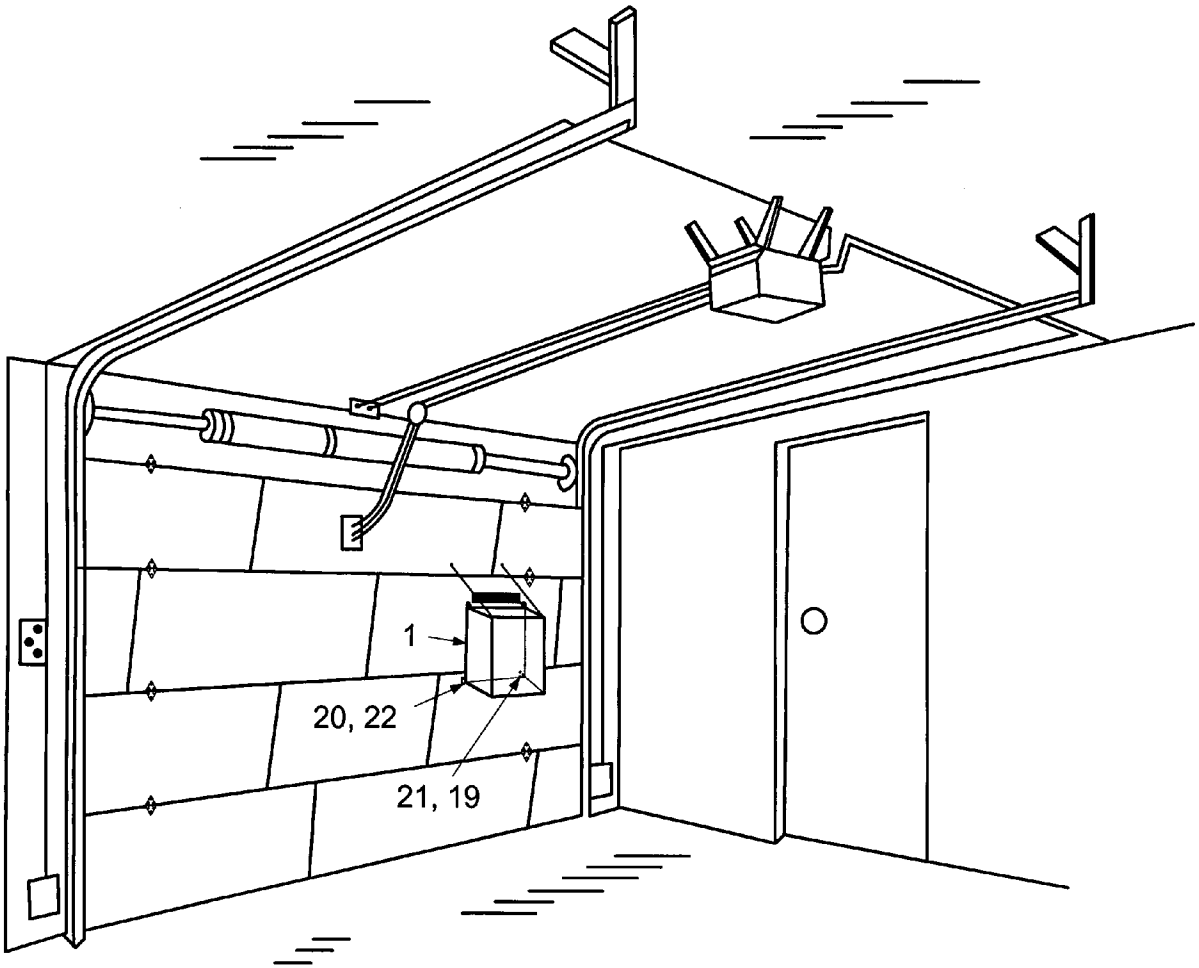
FIG. 14 is a perspective view of the assembly of FIG. 1, FIG. 6, or FIG. 12 mounted to a garage door in a closed (vertical) position.

FIG. 14 is a perspective view of the assembly of FIG. 1, FIG. 6, or FIG. 12 mounted to a garage door in a closed (vertical) position.

FIG. 15 is a perspective view of the assembly of FIG. 1, FIG. 6, or FIG. 12 mounted to a garage door in an open (horizontal) position.

While this invention has been described in terms certain preferred embodiments, it will be appreciated by those skilled in the art that certain modifications, permutations and equivalents thereof are within the inventive scope of the present invention. It is therefore intended that the following appended claims include all such modifications, permutations and equivalents as fall within the true spirit and scope of the present invention.

What is claimed is:

1. A mail bag assembly, including:

a mail bag having a mail-receiving opening; and a supporting subassembly, coupled to the bag so as to hold open the mail-receiving opening, and configured to be mounted to a garage door having a mail slot and to support the bag in an open, mail-holding position, wherein the bag is shaped and dimensioned so as to receive and hold mail when supported by the supporting subassembly in the mail-holding position below the mail slot with the garage door in a vertical position, and to prevent the mail from falling out of the bag when the door is moved from the vertical position to an open, horizontal position, wherein the bag has an upper edge that defines the mail-receiving opening, and the supporting subassembly includes a rod that supports and holds open at least a portion of the upper edge, and wherein the supporting subassembly includes brackets configured to be attached to the garage door, wherein each of the brackets receives the rod so that the rod can be rotatably mounted between the brackets and the door to rotatably mount the mail bag to the door, so that the bag can be folded against the door while the supporting subassembly rotates relative to the door.

2. The assembly of claim 1, wherein each of the brackets has a rod-receiving groove that is shaped and dimensioned to receive an end portion of the rod so that the rod can be rotatably mounted between the brackets and the door.

3. The assembly of claim 2, wherein the supporting subassembly is configured so that the bag in the mail-holding position can be folded into a folded position against the door while the rod rotates relative to the brackets.

4. The assembly of claim 3, also including:

a fastener having a first portion attached to the bag and a second portion configured to be attached to the garage door, wherein the fastener is configured to releasably hold the bag in the folded position against the door when said second portion is attached to the garage door.

5. The assembly of claim 4, wherein the assembly is sufficiently lightweight and the fastener is configured to hold the bag in the folded position against the door with sufficiently weak force that force exerted by mail against the bag, when the mail is pushed through the mail slot against the bag in said folded position, is sufficient to disengage the second portion of the fastener from the first portion of the fastener and cause the bag to rotate back to the mail-holding position to hold said mail.

6. The assembly of claim 4, wherein the fastener is a hook and loop fastener.

7. The assembly of claim 1, wherein at least one elastic loop is attached to the bag and the supporting subassembly includes:

at least one hook member configured to be attached to the door and to the loop to restrict movement of the loop away from the door, and thereby partially support the bag in the open, mail-holding position when the door is in the open, horizontal position.

8. The assembly of claim 1, wherein each of the brackets is generally U-shaped and dimensioned to be attached to a trust portion of the garage door and to receive an end portion of the rod.

9. A garage door and mail bag assembly, including:

a garage door having a mail slot;

a mail bag having a mail-receiving opening; and a supporting subassembly coupled to the bag so as to hold open the mail-receiving opening, wherein the supporting subassembly is mounted to the door so as to support the bag below the mail slot in an open, mail-holding position, and wherein the bag is shaped and dimensioned so as to receive and hold mail when said bag is in the mail-holding position and the garage door is in a vertical position, and to prevent the mail from falling out of the bag when the door is moved from the vertical position to an open, horizontal position, wherein the bag has an upper edge that defines the mail-receiving opening, and the supporting subassembly includes a rod that supports and holds open at least a portion of the upper edge, and wherein the supporting subassembly includes brackets attached to the garage door, wherein each of the brackets receives the rod to rotatably mount the rod between the brackets and the door.

10. The assembly of claim 9, wherein each of the brackets has a rod-receiving groove that receives an end portion of the rod, thereby rotatably mounting the rod between the brackets and the door.

11. The assembly of claim 9, wherein at least one elastic loop is attached to the bag, and the supporting subassembly includes:

at least one hook member attached to the door and in engagement with the loop to restrict movement of the loop away from the door, thereby partially supporting the bag in the open, mail-holding position when the door is in the open, horizontal position.

12. The assembly of claim 9, wherein each of the brackets is generally U-shaped and attached to a trust portion of the garage door and receives an end portion of the rod.

* * * * *